US008721793B2

(12) United States Patent
Hoffmann

(10) Patent No.: US 8,721,793 B2
(45) Date of Patent: May 13, 2014

(54) CONTINUOUS CENTRIFUGE FEED PIPE MIXING SYSTEM

(75) Inventor: Jeffrey R. Hoffmann, Fairfield, OH (US)

(73) Assignee: The Western States Machine Company, Hamilton, OH (US)

( * ) Notice: Subject to any disclaimer, the term of this patent is extended or adjusted under 35 U.S.C. 154(b) by 387 days.

(21) Appl. No.: 13/079,313

(22) Filed: Apr. 4, 2011

(65) Prior Publication Data

US 2012/0252651 A1 Oct. 4, 2012

(51) Int. Cl.
*B04B 3/00* (2006.01)
*B04B 11/02* (2006.01)
*B04B 15/12* (2006.01)

(52) U.S. Cl.
CPC . *B04B 3/00* (2013.01); *B04B 11/02* (2013.01); *B04B 15/12* (2013.01)
USPC ..... 127/19; 494/36; 494/42; 494/60; 210/369; 210/377; 210/380.1

(58) Field of Classification Search
CPC ..... B04B 3/00; B04B 11/00; B04B 15/12
USPC ..... 494/36, 42, 60; 210/369, 377, 380.1; 127/19
See application file for complete search history.

(56) References Cited

U.S. PATENT DOCUMENTS

| | | | |
|---|---|---|---|
| 3,238,063 | A | 3/1966 | Steele |
| 3,393,805 | A | 7/1968 | Laven |
| 3,837,913 | A | 9/1974 | Hilldbrand et al. |
| 3,845,788 | A | 11/1974 | Laven |
| 3,970,470 | A | 7/1976 | Trojan et al. |
| 5,209,856 | A | 5/1993 | Cuel et al. |
| 7,208,048 | B2 | 4/2007 | Eastaughffe |

FOREIGN PATENT DOCUMENTS

| | | |
|---|---|---|
| WO | WO95/21697 | 8/1995 |

*Primary Examiner* — David A Reifsnyder
(74) *Attorney, Agent, or Firm* — Dinsmore & Shohl LLP

(57) ABSTRACT

A feed pipe mixing system for delivering a homogenous massecuite product to a centrifuge comprising: a vertical feed pipe defining an upper end, and a lower end, the vertical feed pipe comprising: a mixing chamber disposed between the upper and lower ends of the vertical feed pipe and operable to mix a massecuite feed with feed water, surfactants, partially diluted molasses or a combination thereof to produce a massecuite product; a massecuite inlet disposed on the side of the vertical feed pipe above the mixing chamber, wherein the massecuite inlet is configured to deliver a massecuite feed into the vertical feed pipe; a massecuite outlet disposed on the lower end of the vertical feed pipe and configured to discharge the homogenous massecuite product from the feed pipe to a centrifuge; and a feed water pipe configured to deliver feed water, surfactants, partially diluted molasses or a combination thereof to the mixing chamber for mixing with the massecuite feed.

24 Claims, 9 Drawing Sheets

CONTINUOUS CENTRIFUGE FEED PIPE MIXING SYSTEM

BACKGROUND

The processing of sugar to produce refined sugar can include several steps, for example, an evaporation step followed by a crystallization process. During an evaporation step, sugar liquor may be concentrated to sugar syrup. Sugar crystals may also evaporate out of solution. The sugar syrup may then be sent to crystallizers for further processing to produce sugar crystals. The resulting mixture from the crystallization step is called massecuite, which may be composed of sugar crystals in a thick, viscous liquid (molasses). The massecuite may also contain dissolved sugar and organic and inorganic impurities. To isolate the sugar crystals, the massecuite may be processed through a centrifuge to separate the sugar crystals from the liquid molasses.

During centrifuge processing, the efficiency and speed of separating the liquid molasses from the solid sugar crystals can be dependent, in part, upon the viscosity of the continuous liquid phase massecuite. Highly viscous massecuite can impede the release of the liquid molasses from the crystals during centrifugation. Viscosity reduction may not necessarily be easily accomplished because the crystals are in equilibrium with the liquid phase and any change by, for example, dilution or temperature may cause the crystals to dissolve.

There are devices available to increase the flowability of the massecuite in large mixers and heat exchangers, but because these devices are so far upstream of the centrifuge processing step, these devices may not provide as thorough viscosity reduction as desired because of the risk of dissolving crystals as mentioned above. Several pre-conditioning systems have been developed over the years including, for example, the Steven Coil by Western States, but these devices are generally reserved for heating the massecuite and agitating the massecuite to facilitate an even distribution of heat transfer. These heated mixers can be very large, and are piped between the crystallizers and centrifuges, and can have very long-residence times.

Accordingly, there is a continual need for improved centrifuge systems, and components therewith, which deliver homogeneous massecuite product to a centrifuge, it is believed that no one prior to the inventors has made or used an invention as described herein.

SUMMARY

The system described herein is a feed pipe mixing system that is designed to be fitted immediately before the centrifuge. The feed pipe mixing system can allow thorough mixing of water, surfactants, partially diluted molasses, and/or steam with the massecuite, while having a short residence time in the system thereby avoiding crystal dissolution and facilitating sugar crystal separation from a highly viscous liquid molasses.

In one embodiment, a feed pipe mixing system for delivering a homogenous massecuite product to a centrifuge is disclosed. The feed pipe mixing system may comprise: a vertical feed pipe defining an upper end, and a lower end. The vertical feed pipe may comprise: a mixing chamber disposed between the upper and lower ends of the vertical feed pipe and operable to mix a massecuite feed with feed water, surfactants, partially diluted molasses or a combination thereof to produce a massecuite product; a massecuite inlet disposed on the side of the vertical feed pipe above the mixing chamber, wherein the massecuite inlet is configured to deliver a massecuite feed into the vertical feed pipe; a massecuite outlet disposed on the lower end of the vertical feed pipe and configured to discharge the homogenous massecuite product from the feed pipe to a centrifuge; and a feed water pipe configured to deliver feed water, surfactants, partially diluted molasses or a combination thereof to the mixing chamber for mixing with the massecuite feed.

The feed pipe mixing system may further comprising an agitator that comprises: a motor disposed on the upper end of the vertical feed pipe; an agitator shaft attached to the motor and axially extending within the vertical feed pipe; and at least one mixing pin attached to said agitator shaft and located within the mixing chamber.

In another embodiment, the centrifuge system may comprise a centrifuge comprising: a basket operable to separate a homogenous massecuite product into sugar and molasses, at least one sugar discharge outlet disposed at an upper end of the basket, and at least one molasses discharge outlet at a lower end of the basket; and a feed pipe mixing system operable to deliver a homogenous massecuite product to the basket. The feed pipe mixing system may comprise a vertical feed pipe defining an upper end, and a lower end, wherein the vertical feed pipe comprises: a mixing chamber disposed between the upper and lower ends of the vertical feed pipe and operable to mix a massecuite feed with feed water, surfactants, partially diluted molasses or a combination thereof to produce a homogenous massecuite product; a massecuite inlet disposed on the side of the vertical feed pipe above the mixing chamber, wherein the massecuite inlet is configured to deliver a massecuite feed into the vertical feed pipe; a massecuite outlet disposed on the lower end of the vertical feed pipe and configured to discharge the homogenous massecuite product from the feed pipe to a continuous centrifuge; and a feed water pipe configured to deliver feed water, surfactants, partially diluted molasses or a combination thereof to the mixing chamber for mixing with the massecuite feed.

Features and benefits of the various embodiments of the present invention will become apparent from the following description, which includes figures and examples of specific embodiments intended to give a broad representation of the invention. Various modifications will be apparent to those skilled in the art from this description and from practice of the invention. The scope is not intended to be limited to the particular forms disclosed and the invention covers all modifications, equivalents and alternatives falling within the spirit and scope of the invention as defined by the claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
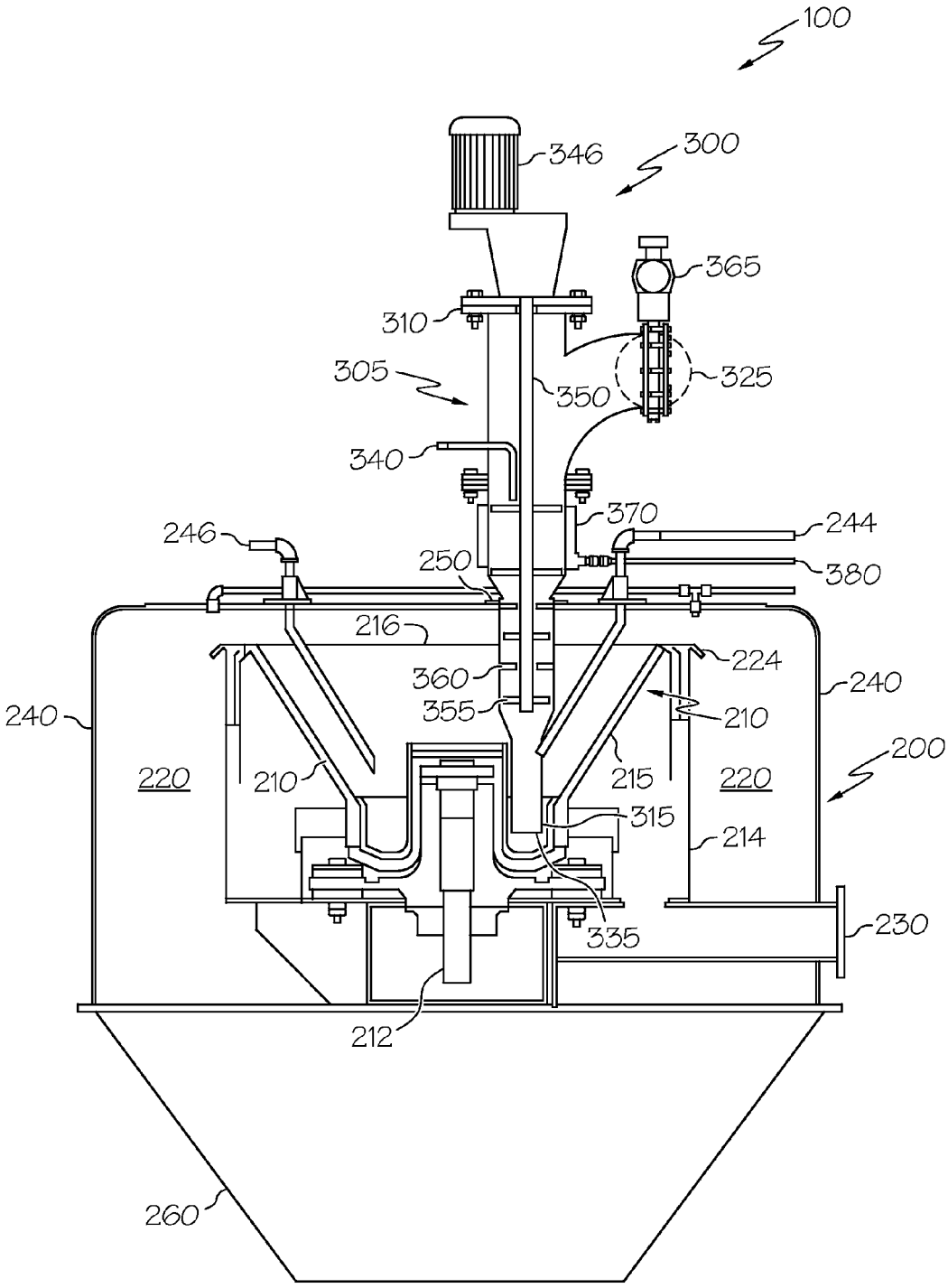
FIG. 1 depicts a side view of an example continuous centrifuge with a side feed system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

Figure 2:
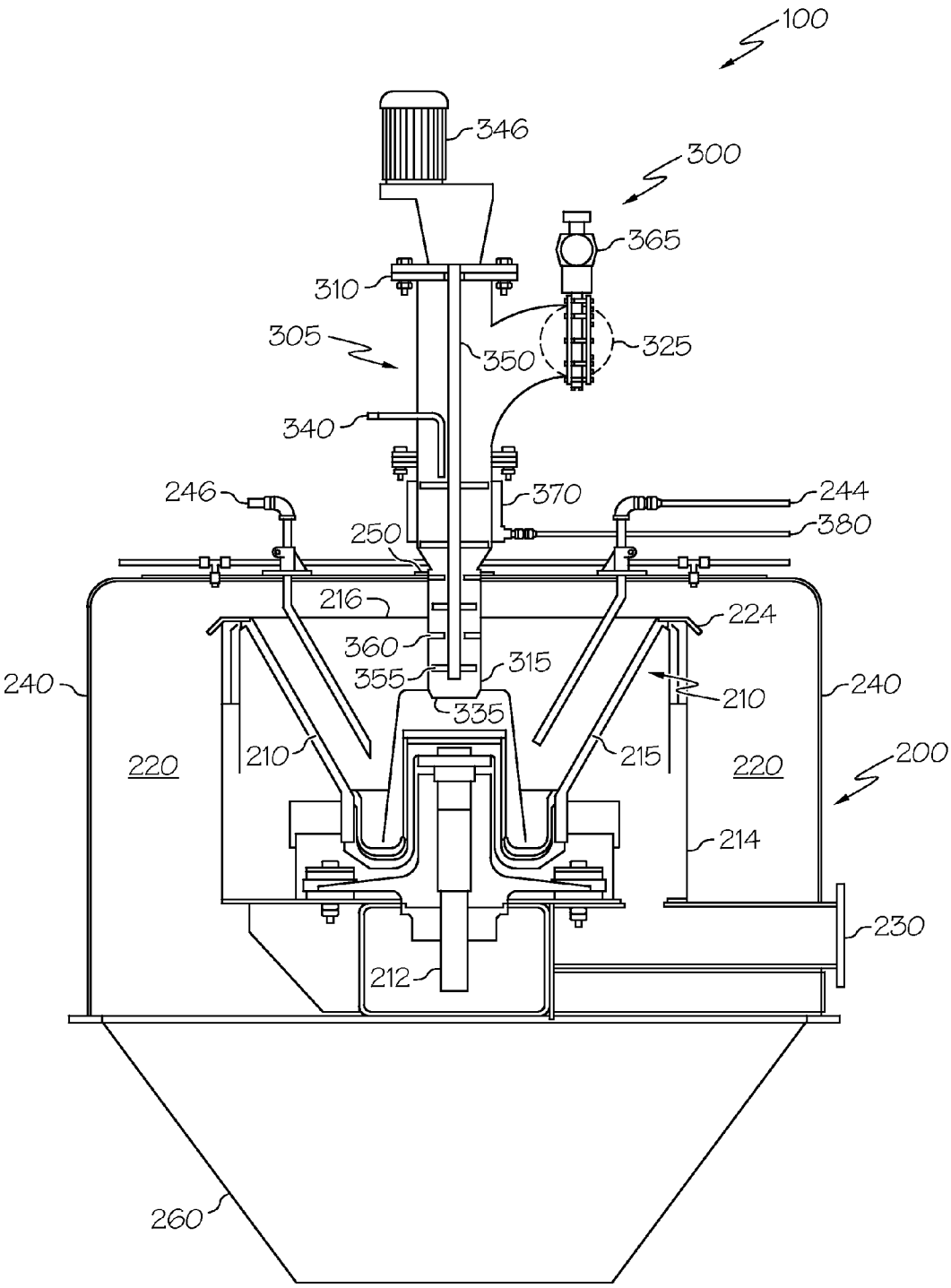
FIG. 2 depicts a side view of an example continuous centrifuge with a center feed system.

Referring to FIGS. 1 & 2, example continuous centrifuge systems 100 are depicted. The continuous centrifuge system 100 comprises a centrifuge 200 and a feed pipe mixing system 300. As shown in FIG. 1, the continuous centrifuge system 100 comprises a side feed pipe mixing system 300. As shown in FIG. 2, the continuous centrifuge system 100 comprises a center feed pipe mixing system 300. Both systems are further described below.

The continuous centrifuge system 100 can operate to separate liquid and solid phases of a suspension. Particularly in a sugar centrifuge system, the continuous centrifuge system 100 can operate to separate sugar crystals from the liquid molasses in a massecuite feed. The feed pipe mixing system 300, which is further described below, can provide homogeneous mixing of materials having different viscosities or to distribute heat evenly during heating of a fluid feed. During sugar processing, for example, the feed pipe mixing system 300 can provide homogeneous mixing of a highly viscous massecuite feed with lower viscous fluids before being fed to centrifuge 200. As used herein, "homogeneous" does not require a fully homogeneous operation. During heating of a massecuite feed, the feed pipe mixing system 300 can distribute the heat evenly throughout the massecuite feed being fed to centrifuge 200.

The centrifuge 200 may comprise a basket 210, a sugar discharge outlet 260, a molasses discharge outlet 230, and a housing 240. The basket 210 may be mounted on a vertical spindle 212 within a labyrinth 214. The labyrinth may function to separate the path to sugar discharge outlet 260 from the path to molasses discharge outlet 230. Thus, the labyrinth can essentially keep the molasses from reentering the chamber where the sugar crystals are discharged. The vertical spindle 212 may be supported in housing 240 and allows for the basket 210 to rotate about a vertical axis. Of course, other configurations may be used to support the vertical spindle 212. For example, the vertical spindle 212 may be supported on a frame structure within the centrifuge 200. The basket 210 can have an inner circular surface which conically extends in an upward direction to an upper open inlet end 216 of the basket 210. In general, the basket 210 may have various shapes, e.g., cylindrical, conical, frustoconical, etc. By way of example only, the basket 210 may be a perforated basket (e.g., 25 to 35 degree cone-shaped basket) or a vertical basket. Basket 210 may use a top (or filtering) screen, which may have a fine mesh for separation of crystals from the molasses. There may also be an intermediate screen, which provides support for the filtering screen and can allow the molasses to flow through it to one of the drainage holes (i.e., perforations) in the basket. The vertical spindle 212 and the basket 210 can be driven at various centrifugal speeds and is operable to separate a homogenous massecuite product into its sugar crystal and liquid molasses components. Basket speed can be affected by the characteristics of the massecuite (e.g., size of the sugar crystals, amount of sugar crystals, viscosity, etc.), centrifuge throughput, etc. For example, the basket 210 and vertical spindle 212 may be driven from about 800 rpm to about 2200 rpm to separate a homogeneous massecuite product into its sugar crystal and liquid molasses components. To provide another example, the basket 210 and vertical spindle 212 may be driven from about 1000 rpm to about 1800 rpm to separate a homogeneous massecuite product into its sugar crystal and liquid molasses components.

The sugar discharge passageway 220 is the passage created between the labyrinth 214 and the housing 240 of centrifuge 200. The separated sugar crystals fall through sugar discharge passageway 220 and exit out of sugar discharge outlet 260. There may be one or more sugar discharge outlets associated with centrifuge 200. The molasses discharge outlet 230 may be disposed at a lower end of the basket 210. The molasses separated from the sugar crystals may be discharged through the molasses discharge outlet 230. There may be one or more molasses discharge outlets associated with centrifuge 200.

Figure 3:
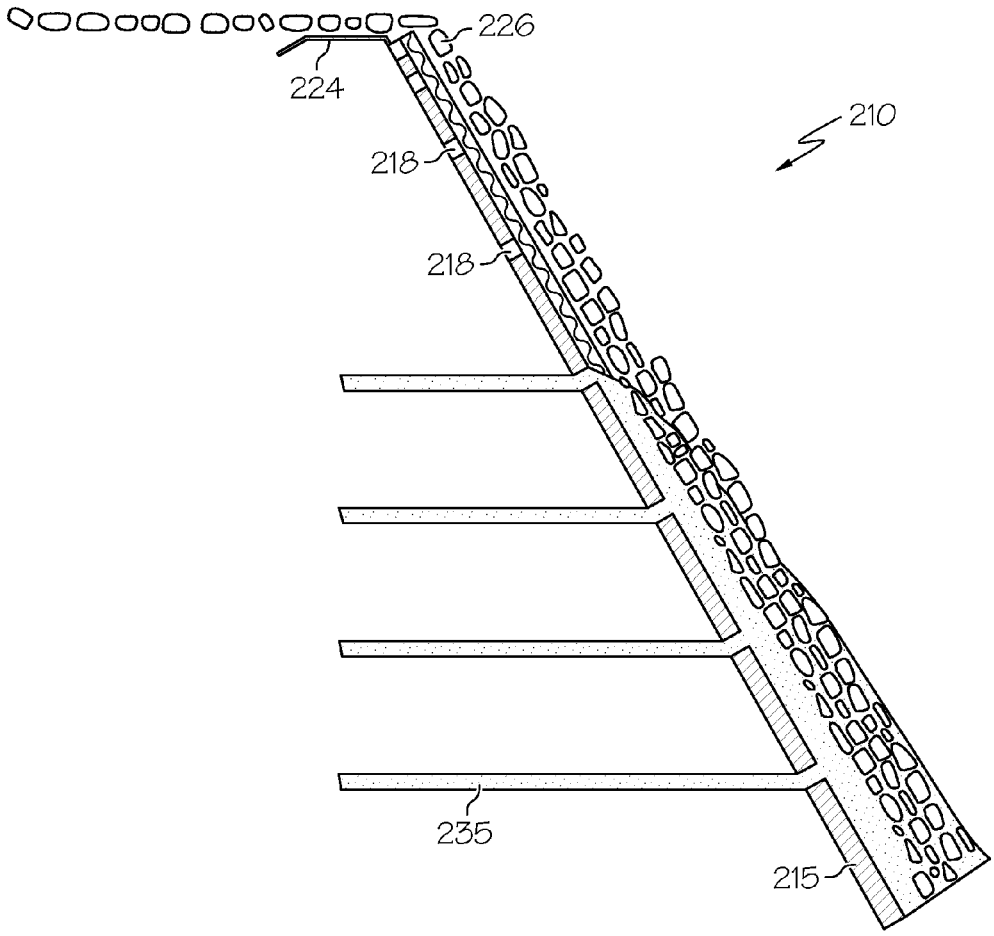
FIG. 3 depicts a side view of an example basket of a continuous centrifuge showing massecuite separation.

The centrifuge may also comprise a wash pipe 246 for introducing a volume of wash liquid into the basket 210 area and a centrifuge steam pipe 244 for introducing steam into the basket 210 area. Use of the wash pipe 246 or centrifuge steam pipe 244 may be necessary at or near spin speed to remove contaminants and the molasses film that may remain on the sugar crystals. As shown in FIGS. 1, 2 & 3, wash pipe 246 may spray wash liquid to pass through the sugar crystal bed, flow through the screen and perforations 218 of the basket 210. Of course, it may be necessary to minimize the use of wash liquid and/or steam or vary the timing of use as a loss of sugar crystals can occur through sugar crystals dissolving in the wash liquor or steam. The wash liquid and/or steam may be applied when the bulk of the liquid molasses has been separated so as to avoid potentially washing sugar crystals too early, which may require excess wash liquid to remove molasses that would otherwise be removed by centrifugal force, or potentially washing too late, which may require extra spin time to remove the wash liquor from the sugar crystals.

In operation, as shown in FIG. 3, the walls 215 of basket 210 may be angled such that the sugar crystals 226 and liquid molasses 235 can migrate up the basket 210 wall as the centrifuge rotates. The liquid molasses 235 flows through the perforations 218 of basket 210 as it is subjected to increasing centrifugal force of rotation. The sugar crystals 226 remain on the walls 215 of the basket 210 and move to the top of the basket 210 and are discharged over the lip 224 through sugar discharge passageway 220 and ultimately discharged out of sugar discharge outlet 260 that may be disposed at a lower end of the sugar discharge passageway 220. As depicted in FIGS. 1 & 2, the labyrinth 214 of the centrifuge 200 guides the liquid molasses 235 that has been separated to the molasses discharge outlet 230. The centrifuge process may be performed at a massecuite temperature from about 50° C. to about 80° C. and/or with a massecuite having a viscosity from about 50,000 centipoises to about 100,000 centipoises.

The massecuite feed may be delivered into basket 210 from a storage or supply tank (not pictured) or may come directly from a prior sugar processing step, e.g., crystallization. The feed flows into the basket 210 through feed pipe mixing system 300 to a central opening 250 at the top of the housing 240. The feed pipe, which is also shown in FIGS. 6 & 7, will be described in further detail below.

The centrifuge loading conditions may vary depending upon the feed rate and viscosity when introducing the feed into centrifuge 200. The feed may be delivered into the basket 210 while basket 210 is rotating at a relatively low speed. Regardless of incoming rate, the feed first touches the basket at its bottom and then travels upward by centrifugal force.

Figure 4:
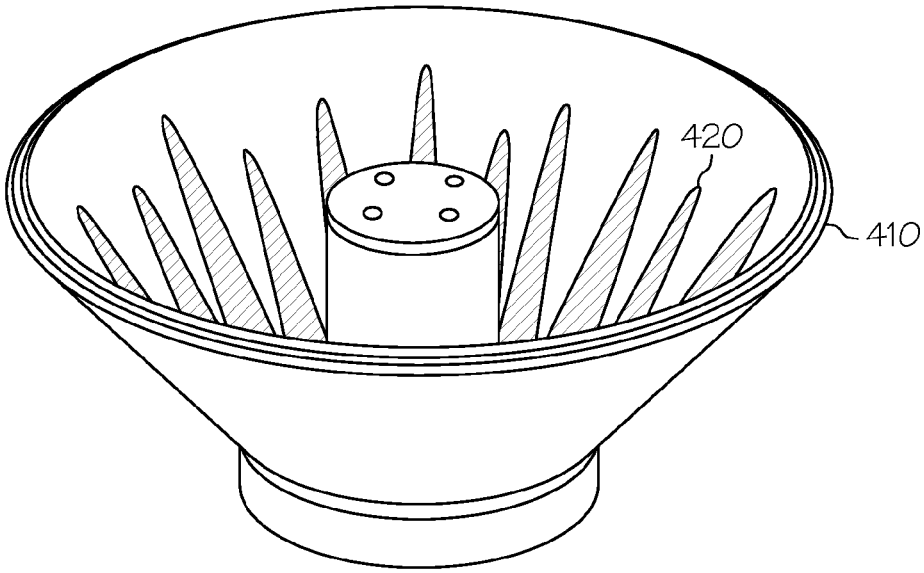
FIG. 4 is a perspective view of a basket of a continuous centrifuge system, which does not utilize the present feed pipe mixing system prior to massecuite separation, wherein the basket demonstrates long massecuite streaks.
Figure 5:
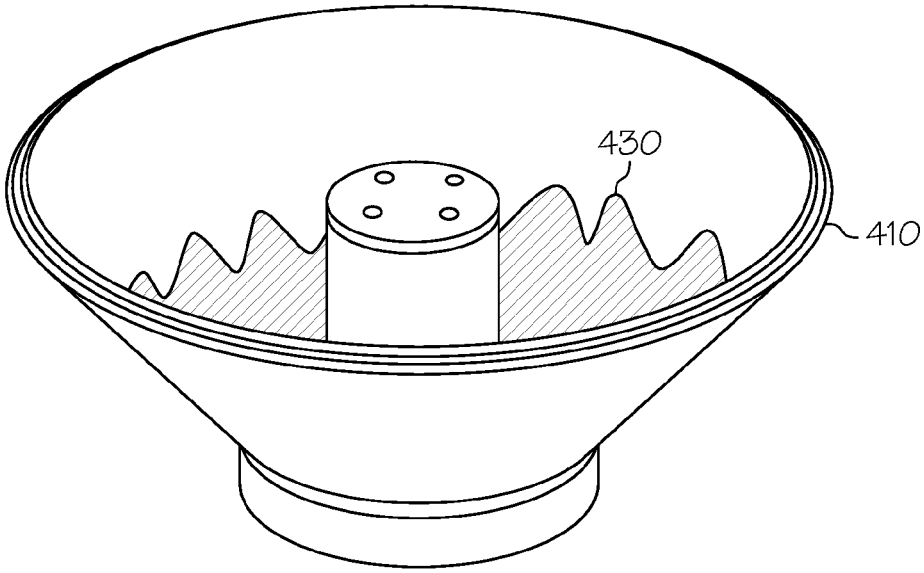
FIG. 5 depicts a perspective view of an example basket of present continuous centrifuge system which utilizes the present feed pipe mixing system prior to massecuite separation, wherein the basket demonstrates short massecuite streaks.

Referring to FIGS. 1 & 2, the feed pipe mixing system 300 can deliver a homogeneous massecuite feed to the centrifuge 200. The side feed pipe mixing system 300 of FIG. 1 delivers a massecuite feed into the bottom of the basket 210 as it rotates. The center feed pipe mixing system 300 of FIG. 2 delivers a massecuite feed using an inverted cone 385, which by gravity and centrifugal force, forces the massecuite down and out evenly through to the bottom of the basket 210 as it rotates. The feed pipe mixing system 300 can work to lower the viscosity of the massecuite so that a faster and more effective crystal-liquid separation may result. In cases where mixing may not be efficient or homogeneous, as shown in FIG. 4, striations or streaks of molasses (also known as "fingers") 420 may be observed inside the basket 210. The long streaks of molasses 420 may indicate a high viscosity molasses that is not purging as quickly as the adjacent areas. This can result from, for example, uneven mixing of molasses with other lower viscosity fluids or uneven heat distribution. However, FIG. 5 depicts short fingers 430, which can indicate that the molasses is purging at a fairly constant rate. This can result when a homogeneous mixture is fed to the basket 210 after passing through feed pipe mixing system 300. The feed pipe mixing system 300 can provide a more uniform dispersion of phases, i.e., improved mixing efficiency, in a low shear environment.

Figure 6:
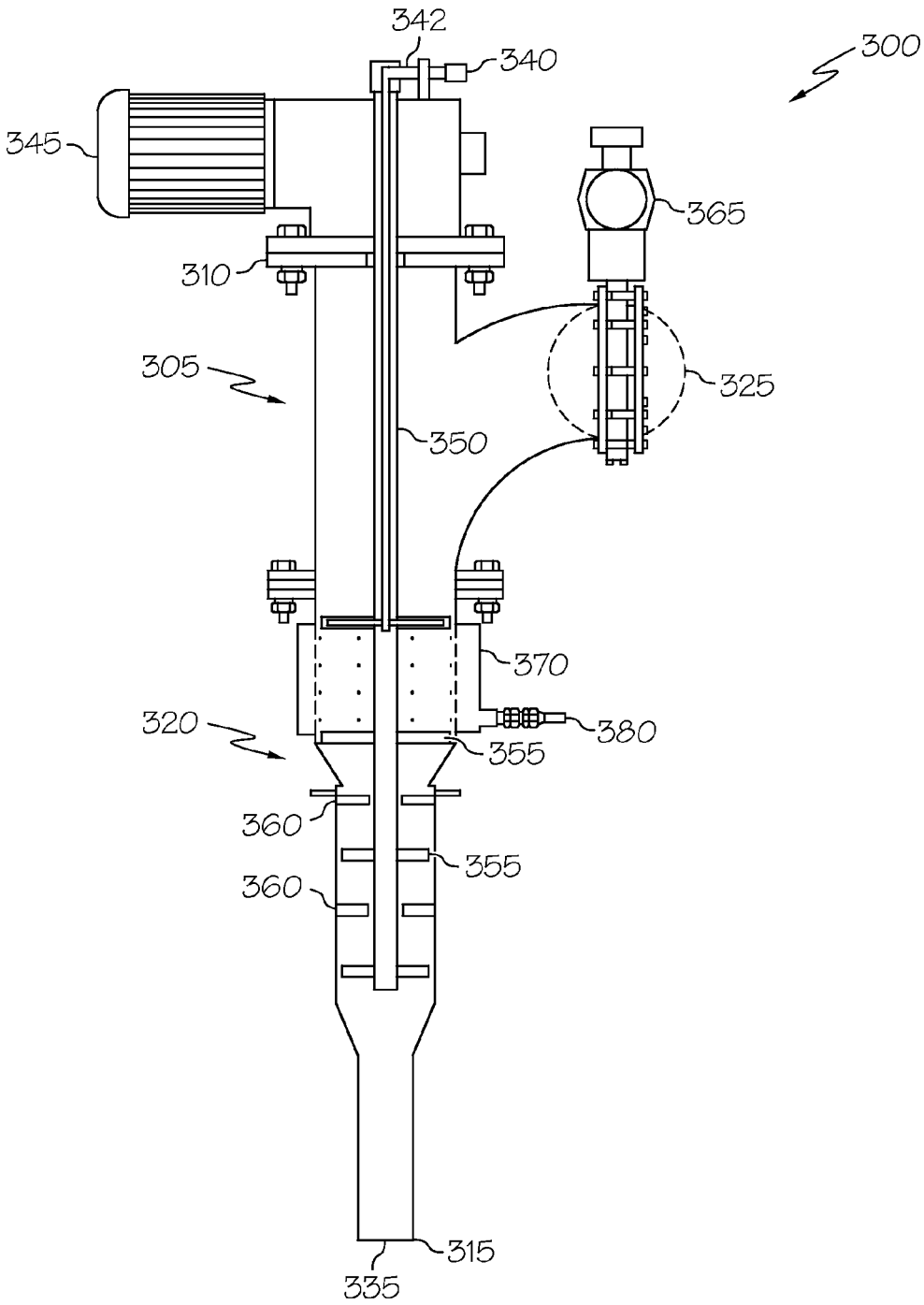
FIG. 6 depicts a side view of an example modified feed system with a right angle motor.
Figure 7:
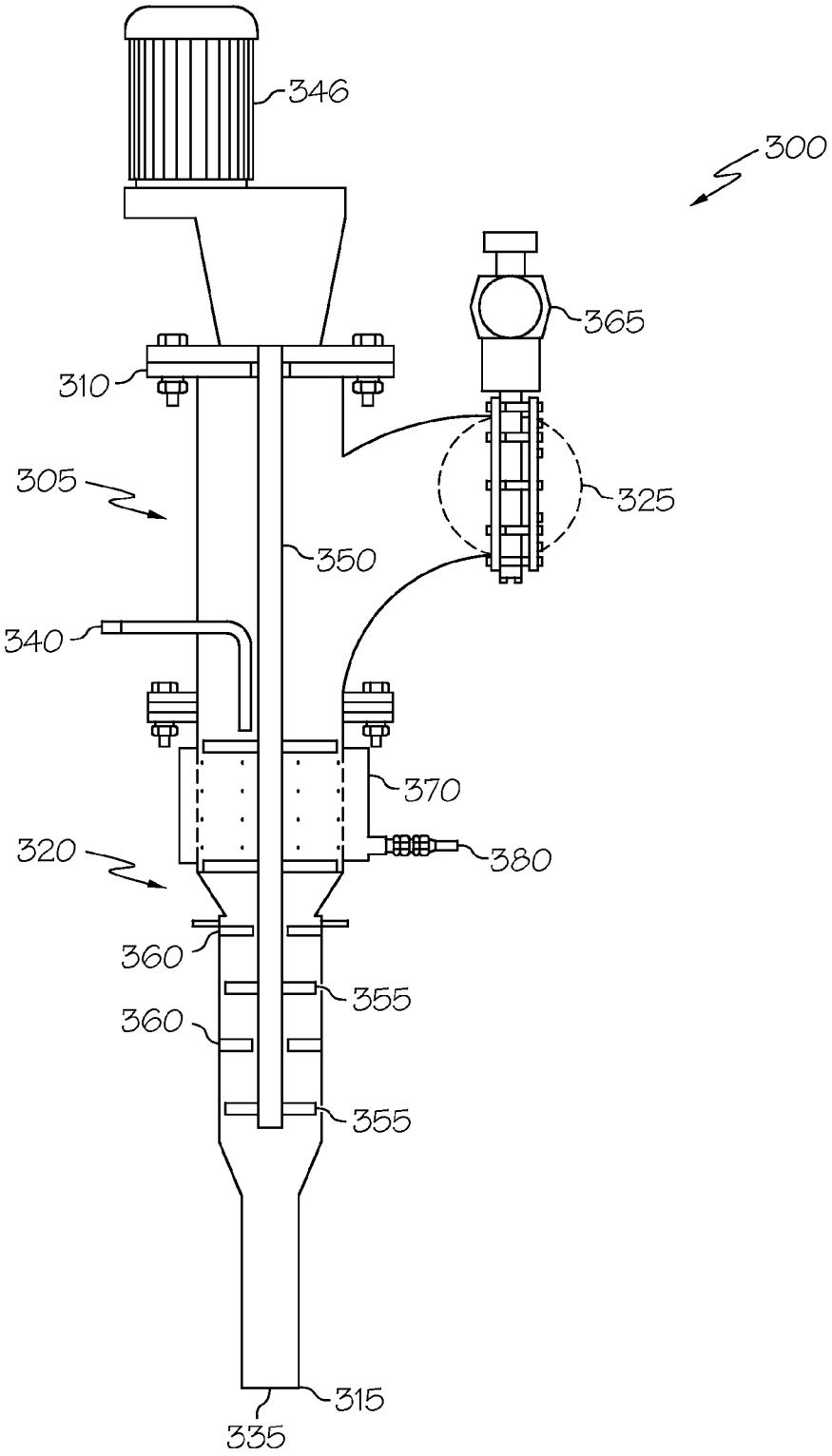
FIG. 7 depicts a side view of an example modified feed system with an in-line motor.

FIGS. 1, 2, 6 and 7 further depict example feed pipe mixing systems 300 used to deliver a homogeneous massecuite feed to the centrifuge 200. As shown in FIGS. 1, 2, 6 and 7, the feed pipe mixing system 300 comprises a vertical feed pipe 305 defining an upper end 310, and a lower end 315, wherein the vertical feed pipe 305 comprises a mixing chamber 320 disposed between the upper 310 and lower 315 ends of the vertical feed pipe 305. The mixing chamber 320 may be operable to mix a massecuite feed with feed water, surfactants, or both to produce a massecuite product. The massecuite feed may enter through a massecuite inlet 325 disposed on the side of the vertical feed pipe 305 above the mixing chamber 320. The massecuite inlet 325 is configured to deliver a massecuite feed into the vertical feed pipe. A massecuite outlet 335 may be disposed on the lower end 315 of the vertical feed pipe 305 and may be configured to discharge a homogenous massecuite product from vertical feed pipe 305 to a continuous centrifuge. The vertical feed pipe 305 may also have a feed water pipe 340 is a co-axial feed water pipe as depicted in FIG. 6 and a separate feed water pipe as depicted in FIG. 7. The feed water pipe 340 is configured to deliver low viscosity fluids, e.g., feed water, surfactants, partially diluted molasses or a combination thereof to the mixing chamber 320 for mixing with the massecuite feed. As used herein "viscous fluids" means fluids with a viscosity that is at least less than the viscosity of the massecuite feed. The low viscosity fluids may be delivered upstream of the mixing chamber 320 and/or upstream of the steam jacket region 370, which are described below.

Referring to FIG. 6, the feed water pipe 340 may comprise a rotary union 342. The rotary union 342 may be operable to dispense low viscosity fluids, e.g., water, surfactant, partially diluted molasses or a combination thereof into the feed pipe. As described above, the addition of these low viscosity fluids can also reduce the massecuite viscosity. Specifically, the addition of surfactants can reduce the surface tension of the massecuite and facilitate the separation of sugar crystals from the liquid molasses, i.e., purging. The total amount of low viscosity fluids added may range from about 0% to about 8% by weight of massecuite. In another example, the total amount of low viscosity fluids added may also range from about 0% to about 6% by weight of massecuite. The addition of low viscosity fluids (e.g., water, surfactants, partially diluted molasses, etc.) to a highly viscous massecuite can lead to difficulty or an inability of the two fluids to readily mix without the use of feed pipe mixing system 300. The feed pipe mixing system 300 can work to reduce the amount of low viscosity fluids necessary to add to a saturated suspension of sucrose and water to lower the massecuite viscosity. Therefore, feed pipe mixing system 300 can aid in minimizing a shift in the equilibrium in favor of dissolution where sucrose crystals may dissolve back into solution.

In addition, because a small amount of low viscosity water or surfactants (e.g., 1 centipoises at 20° C.) or slightly more viscous dilute molasses may be added to the high viscosity massecuite, they may not mix readily without the use of feed pipe mixing system 300. The feed pipe mixing system 300 can avoid the problem of very limited mixing that may occur in the feed pipe after the fluids have been added. If no mixing occurs within the feed pipe, some mixing may occur when the combined fluids and massecuite enter the high-speed rotating components of the centrifuge. However, the residence time is often less than a few seconds and mixing may not be efficient or homogeneous. Therefore, the use of feed pipe mixing system 300, can work to minimize inefficient or non-homogeneous mixing. As depicted in FIG. 4, long streaks of molasses are seen inside a centrifuge basket as described above and depicted in FIG. 3.

Referring to FIG. 6, the feed pipe mixing system 300 may further comprise an agitator comprising a right-angle motor 345, agitator shaft 350 and at least one mixing pin 355. The agitator shaft 350 may be designed to smoothly interrupt the flow of fluid to cause a mixing action. The right-angle motor 345 may be disposed on the upper end 310 of the vertical feed pipe 305. While the motor shown in FIG. 6 is a right-angle motor 345, the motor as shown in FIGS. 1, 2 & 7 is an in-line motor 346. Of course, other types of motors may be used and will be apparent to those of ordinary skill in the art in view of the teachings herein.

The right-angle motor 345 depicted in FIG. 6 of the feed pipe mixing system 300 may be an AC or DC motor that has a rotational axis that is perpendicular to a rotational axis of agitator shaft 350. Referring to FIGS. 1, 2 & 7, the feed pipe mixing system 300 may comprise an in-line motor 346, where the rotational axis of the motor is in-line with a rotational axis of the agitator shaft 350. The right-angle motor 345 and in-line motor 346 may also comprise an inverter which can be a variable frequency drive (VFD) that may allow, for example, a standard 3-phase alternating current (AC) motor to vary in speed from near 0% of speed to 200% of normal speed by varying the electrical frequency from 0-120 Hertz.

Either right-angle motor 345 or in-line motor 346 may rotate the agitator shaft 350 at a speed ranging from about 1 rpm to about 360 rpm.

The agitator shaft 350 may be attached or coupled to either right-angle motor 345 or in-line motor 346 and can extend axially within the vertical feed pipe 305. Referring to FIG. 6, the agitator shaft 350 may also be coupled to the feed water pipe 340. Example rotary joints or rotary unions that may be used include BARCO rotary joints or JOHNSON rotary joints. The agitator shaft 350 may be coupled to the right-angle motor 345 to rotatably drive the agitator shaft. Of course, various configurations may be used to couple the agitator shaft 350 to right-angle motor 345 so as to impart rotation about the axis of the agitator shaft 350 within the vertical feed pipe 305.

The agitator shaft 350 may be a simple solid shaft, as depicted in FIGS. 1, 2 & 7, or a hollow shaft, as depicted in FIG. 6. As depicted in FIG. 6, the feed water, surfactants, or both may be introduced using feed water pipe 340 through the agitator shaft 350 at the at least one mixing pin 355.

At least one mixing pin 355 may be attached to the agitator shaft 350 and located within the mixing chamber 320. The at least one mixing pin 355 may radially extend from the agitator shaft 350. The surface area of the at least one mixing pin, the number of mixing pins, and speed of rotation will all increase mixing. If a pin is in the form of a blade that is too sharp, it may induce mixing, but can also cause damage to the crystals. The at least one mixing pin 355 should mix fluids with limited or low shear. In addition, the at least one mixing pin should cause minimal breakage of friable particles, such as sugar crystals.

Figure 8:
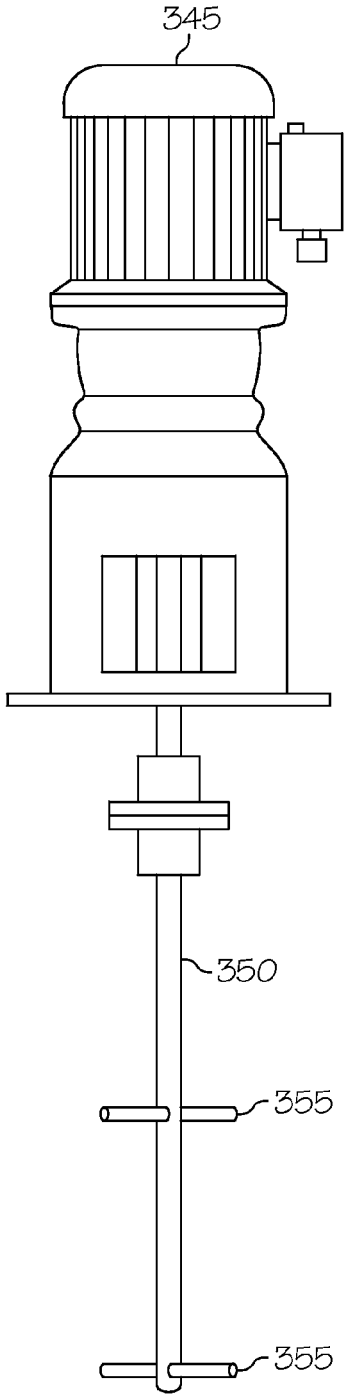
FIG. 8 depicts a side view of an example agitator having two sets of mixing pins.
Figure 9:
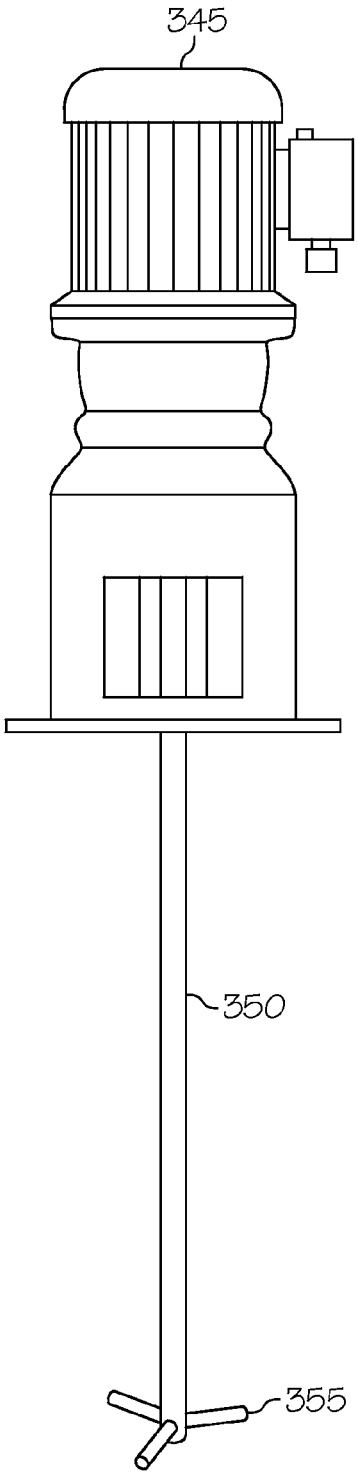
FIG. 9 depicts a side view of an example agitator having one set of mixing pins.
Figure 10:
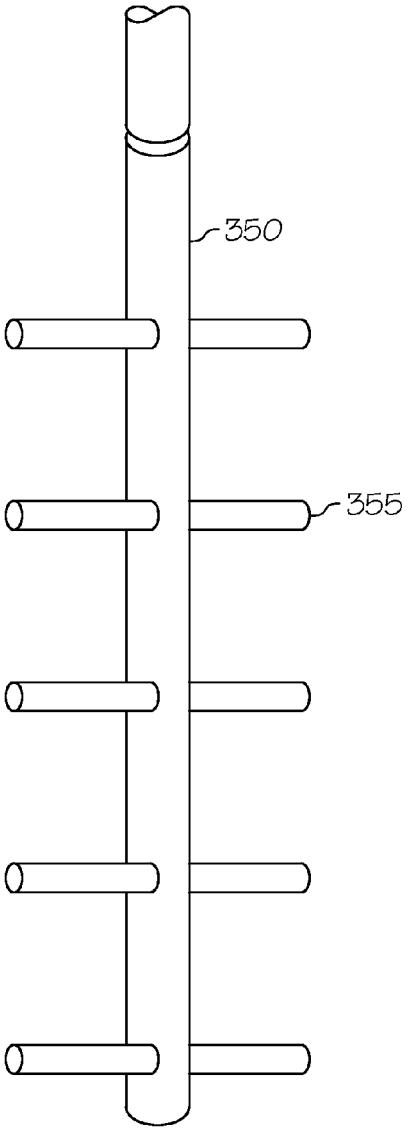
FIG. 10 depicts an example configuration for a set of mixing pins.
Figure 11:
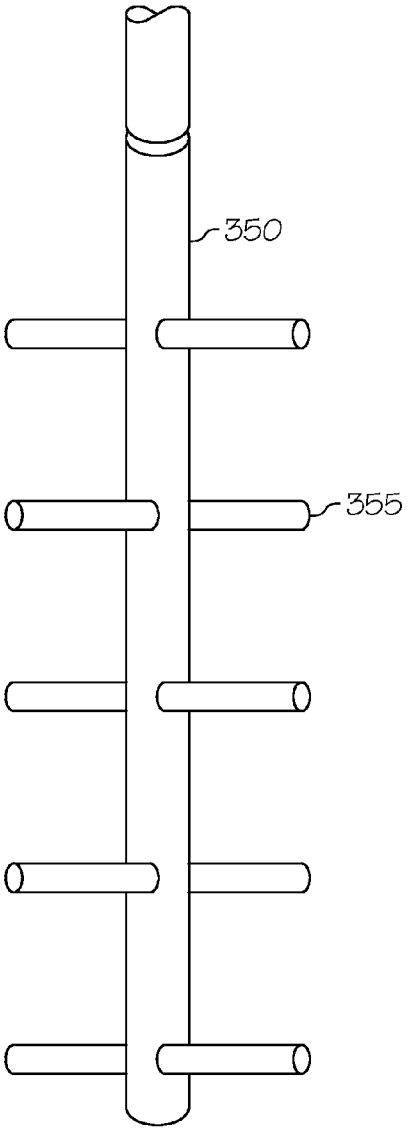
FIG. 11 depicts an example configuration for a set of mixing pins.

The at least one mixing pin 355 may have a number of configurations. For example, the at least one mixing pin 355 may be arms, rods, blades or any other vane-like structures that induce movement of a fluid. The at least one mixing pin 355 may be single staggered axially-spaced pins angularly placed on the agitator shaft 350. Alternatively, groups of two or more may be placed angularly around the agitator shaft 350, e.g., diametrically opposite as shown in FIG. 10. Each pin may be shaped and/or angled to produce radial and axial flow of the massecuite. Of course, various other configurations for the at least one mixing pin 355 will be apparent to those of ordinary skill in the art in accordance with the teachings herein. For example, in alternative embodiments, the agitator shaft 350 may have mixing pins varying in size and/or shape disposed on an agitator shaft, the mixing pins may be arranged in a staggered configuration on an agitator shaft 350, as shown in FIG. 11, and/or mixing pins that extend the entire length of an agitator shaft 350. In one example, as depicted in FIGS. 6 and 7, the at least one mixing pin 355 may comprise round rods projecting from agitator shaft 350 to induce mixing. In another example, as depicted in FIG. 8, the at least one mixing pin 355 may comprise two sets of two symmetrical pins arranged diametrically opposite one another (offset by 180°) and attached to agitator shaft 350. In a further example, as depicted in FIG. 9, the at least one mixing pin 355 may comprise one set of three angled pins radially extending from agitator shaft 350.

The at least one mixing pin 355 can be mounted on an agitator shaft 350 that is centered or off center relative to vertical feed pipe 305 and/or mixing chamber 320. As shown in FIGS. 1, 2, 6 and 7, vertical feed pipe 305 may be equipped with baffles 360 extending inwardly from the inside of the vertical feed pipe 305 wall toward the agitator. The baffles may provide for flow disruption of the massecuite feed which can add another element of mixing by creating a distributive mixing effect. The baffles may also prevent the mass of massecuite from rotating with the agitator, which could happen if the massecuite or fluid being mixed has a low surface tension with the wall and slides too easily. Alternatively, vertical feed pipe 305 may have no baffles therein. These variations may be made depending upon massecuite properties and process requirements.

The feed pipe mixing system 300 may further comprise a fluid flow control device 365 disposed at the massecuite inlet 325 that is configured for controlling entry of the massecuite feed into vertical feed pipe 305. The fluid flow control device 365 may be a fluid flow regulating valve that may be a butterfly valve, a knife valve, gate valve, etc. Of course, other suitable valves or fluid flow control devices may be apparent to those of ordinary skill in the art in view of the teachings herein.

The feed pipe mixing system 300 may further comprise a steam jacket region 370, having a steam inlet 380, as shown in FIGS. 1, 2, 6 and 7. The mixing chamber 320 may be provided with a steam jacket region 370 to increase the temperature of massecuite fluid entering the mixing chamber 320. Increasing the temperature of massecuite will reduce massecuite viscosity. When temperature increases are used in conjunction with the feed pipe mixing system 300, the feed pipe mixing system 300 can reduce the amount of sugar crystals re-dissolving with an increase with temperature by providing for better heat distribution thereby reducing the heat requirements. The feed pipe mixing system 300 can also help minimize sugar losses due to sugar crystals being dissolved by excess water or heat by dissolving into the molasses.

The steam jacket region 370 may be disposed upstream of the mixing chamber 320. Alternatively, the steam jacket region 370 may be disposed in the mixing chamber 320 region. Steam may enter the steam jacket region 370 through a steam inlet 380, which optionally is regulated through a control valve. Alternatively, the steam inlet 380 may permit entry of steam directly into vertical feed pipe 305. In one example, steam inlet 380 may be disposed on the side of vertical feed pipe 305 just upstream of the mixing chamber 320. In another example, steam inlet 380 may be disposed on the side of vertical feed pipe 305 in the mixing chamber 320 region.

The temperature of the massecuite fluid may be measured using a temperature sensor and controlled by an automatic temperature controller, which throttles the control valve to admit the required amount of steam for providing and maintaining a desired temperature. Of course, the massecuite fluid temperature may be increased and/or maintained by other methods. For example, massecuite fluid temperature may be increased and/or maintained by indirect methods, such as, contact with a stationary or rotating heated surface.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Versions of the devices described above may be actuated mechanically or electromechanically (e.g., using one or more electrical motors, solenoids, etc.). However, other actuation modes may be suitable as well including but not limited to pneumatic and/or hydraulic actuation, etc. Various suitable ways in which such alternative forms of actuation may be provided in a device as described above will be apparent to those of ordinary skill in the art in view of the teachings herein.

Versions of the devices described above may have various types of construction. By way of example only, any of the devices described herein, or components thereof, may be constructed from suitable metals, ceramics, plastics, or combinations thereof. Various suitable ways in which these and other modifications to the construction of devices described herein may be carried out will be apparent to those of ordinary skill in the art in view of the teachings herein.

Having shown and described various versions in the present disclosure, further adaptations of the devices and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A feed pipe mixing system for delivering a homogenous massecuite product to a centrifuge, the feed pipe mixing system comprising:

a vertical feed pipe defining an upper end, and a lower end, wherein the vertical feed pipe comprises:

(a) a mixing chamber disposed between the upper and lower ends of the vertical feed pipe and operable to mix a massecuite feed with feed water, surfactants, partially diluted molasses or a combination thereof to produce the homogenous massecuite product;

(b) a massecuite inlet disposed on a side of the vertical feed pipe above the mixing chamber, wherein the massecuite inlet is configured to deliver a massecuite feed into the vertical feed pipe;

(c) a massecuite outlet disposed on the lower end of the vertical feed pipe and configured to discharge the homogenous massecuite product from the vertical feed pipe to the centrifuge; and (d) a feed water pipe configured to deliver feed water, surfactants, partially diluted molasses or a combination thereof to the mixing chamber for mixing with the massecuite feed;

an agitator configured to mix the massecuite feed in the mixing chamber, the agitator comprising:

a motor disposed on the upper end of the vertical feed pipe, and an agitator shaft attached to the motor and axially extending within the vertical feed pipe.

2. The feed pipe mixing system of claim 1, further comprising a fluid flow control device disposed at the massecuite inlet and configured for controlling entry of the massecuite feed into the vertical feed pipe.

3. The feed pipe mixing system of claim 2, wherein the fluid flow control device is a butterfly valve.

4. The feed pipe mixing system of claim 1, wherein the feed water pipe comprises a rotary union, wherein the rotary union is operable to dispense feed water, surfactants, partially diluted molasses or a combination thereof into the vertical feed pipe.

5. The feed pipe mixing system of claim 1, further comprising a steam inlet disposed upstream of the mixing chamber on the vertical feed pipe, wherein the steam inlet permits entry of steam into the vertical feed pipe.

6. The feed pipe mixing system of claim 5, wherein the steam inlet is disposed on the side of the vertical feed pipe.

7. The feed pipe mixing system of claim 1, further comprising a steam jacket region disposed upstream of the mixing chamber on the vertical feed pipe.

8. The feed pipe mixing system of claim 7, wherein the feed water pipe is configured to deliver feed water, surfactants, partially diluted molasses or a combination thereof upstream of the steam jacket region.

9. The feed pipe mixing system of claim 1, wherein the agitator further comprises at least one mixing pin attached to said agitator shaft and located within the mixing chamber.

10. The feed pipe mixing system of claim 1, wherein the motor is configured to rotate the agitator shaft, wherein a rotational axis of the motor is perpendicular to a rotational axis of the agitator shaft.

11. The feed pipe mixing system of claim 1, wherein the motor is configured to rotate the agitator shaft, wherein a rotational axis of the motor is in-line with a rotational axis of the agitator shaft.

12. The feed pipe mixing system of claim 1, wherein the motor rotates the agitator shaft at a speed ranging from about 1 rpm to about 360 rpm.

13. A centrifuge system comprising:

(a) a centrifuge comprising:

a basket operable to separate a homogenous massecuite product into sugar and molasses, at least one sugar discharge outlet disposed at an upper end of the basket, and at least one molasses discharge outlet at a lower end of the basket; and (b) a feed pipe mixing system operable to deliver the homogenous massecuite product to the basket, the feed pipe mixing system comprising a vertical feed pipe defining an upper end, and a lower end, wherein the vertical feed pipe comprises:

a mixing chamber disposed between the upper and lower ends of the vertical feed pipe and operable to mix a massecuite feed with feed water, surfactants, partially diluted molasses or a combination thereof to produce the homogenous massecuite product;

a massecuite inlet disposed on a side of the vertical feed pipe above the mixing chamber, wherein the massecuite inlet is configured to deliver a massecuite feed into the vertical feed pipe;

a massecuite outlet disposed on the lower end of the vertical feed pipe and configured to discharge the homogenous massecuite product from the vertical feed pipe to the centrifuge;

a feed water pipe configured to deliver feed water, surfactants, partially diluted molasses or a combination thereof to the mixing chamber for mixing with the massecuite feed;

a motor disposed on the upper end of the vertical feed pipe; and an agitator shaft attached to the motor, wherein the agitator shaft is configured to mix the massecuite feed in the mixing chamber.

14. The centrifuge system of claim 13, further comprising a fluid flow control device disposed at the massecuite inlet and configured for controlling entry of the massecuite feed into the vertical feed pipe.

15. The centrifuge system of claim 14, wherein the fluid flow control device is a butterfly valve.

16. The centrifuge system of claim 13, wherein the feed water pipe comprises a rotary union, wherein the rotary union is operable to dispense feed water, surfactants, partially diluted molasses or a combination thereof into the vertical feed pipe.

17. The centrifuge system of claim 13, further comprising a steam inlet disposed upstream of the mixing chamber on the vertical feed pipe, wherein the steam inlet permits entry of steam into the vertical feed pipe.

18. The centrifuge system of claim 17, wherein the steam inlet is disposed on the side of the vertical feed pipe.

19. The centrifuge system of claim 13, further comprising a steam jacket region disposed upstream of the mixing chamber on the vertical feed pipe.

20. The centrifuge system of claim 19, wherein the feed water pipe is configured to deliver feed water, surfactants, partially diluted molasses or a combination thereof upstream of the steam jacket region.

21. The centrifuge system of claim 13, further comprising at least one mixing pin attached to said agitator shaft and located within the mixing chamber.

22. The centrifuge system of claim 13, wherein the motor is configured to rotate the agitator shaft, wherein a rotational axis of the motor is perpendicular to a rotational axis of the agitator shaft.

23. The centrifuge system of claim 13, wherein the motor is configured to rotate the agitator shaft, wherein a rotational axis of the motor is in-line with a rotational axis of the agitator shaft.

24. The centrifuge system of claim 13, wherein the motor rotates the agitator shaft at a speed ranging from about 1 rpm to about 360 rpm.

* * * * *